United States Patent [19]

Wiener

[11] 4,283,933

[45] Aug. 18, 1981

[54] GRIPPING OR PRESSING TOOL

[75] Inventor: Hans Wiener, Täby, Sweden

[73] Assignee: Pressmaster A.B., Stockholm, Sweden

[21] Appl. No.: 81,932

[22] Filed: Oct. 4, 1979

Related U.S. Application Data

[63] Continuation-in-part of Ser. No. 852,724, Nov. 18, 1977, Pat. No. 4,199,972, which is a continuation-in-part of Ser. No. 647,641, Jan. 8, 1976, Pat. No. 4,078,303.

[51] Int. Cl.[3] ..... B21D 37/12

[52] U.S. Cl. ..... 72/409; 81/419

[58] Field of Search ..... 72/385, 409, 410, 416; 81/347, 348, 350, 351, 352, 419, 5.1 R; 194/3 R, DIG. 2

[56] References Cited

U.S. PATENT DOCUMENTS

| | | | |
|---|---|---|---|
| 920,834 | 5/1909 | Deevy | 72/409 |
| 2,584,353 | 2/1952 | Keiser | 81/347 |
| 2,639,754 | 5/1953 | Macy | 81/348 |
| 2,743,634 | 5/1950 | Badeau | 72/431 |
| 2,783,669 | 3/1957 | Scarborough | 81/350 |
| 2,814,222 | 11/1957 | Sanders | 72/409 |
| 3,417,599 | 12/1968 | Burns | 72/431 |

FOREIGN PATENT DOCUMENTS

| | | | |
|---|---|---|---|
| 340581 | 9/1921 | Fed. Rep. of Germany | 72/385 |
| 80554 | 8/1919 | Switzerland | 72/409 |

*Primary Examiner*—Lowell A. Larson
*Attorney, Agent, or Firm*—Karl F. Ross

[57] ABSTRACT

A tool such as a pair of pliers, designed to handle cables, rods and similar workpieces of generally circular cross-section, has two coacting jaws swingably linked via respective shanks with operating means such as a pair of handles. The two shanks are limitedly relatively rotatable about a pivotal axis paralleling the swing axes of the jaws, each jaw comprising an elongate base with upstanding parallel webs transverse to the swing plane having workpiece-engaging faces alternately inclined in opposite directions with reference to that plane so as to form a channel around the workpiece in a working position. The relative motion of the shanks can be limited by an abutment or a link to establish a position of maximum jaw separation in which at least the webs closest to the pivotal axis still interengage to insure proper interfitting of all the webs upon the next return to the working position. Alternatively, or conjointly therewith, the separated jaws are resiliently biased against stops on their shanks holding their webs and interstices mutually aligned for interengagement.

7 Claims, 3 Drawing Figures

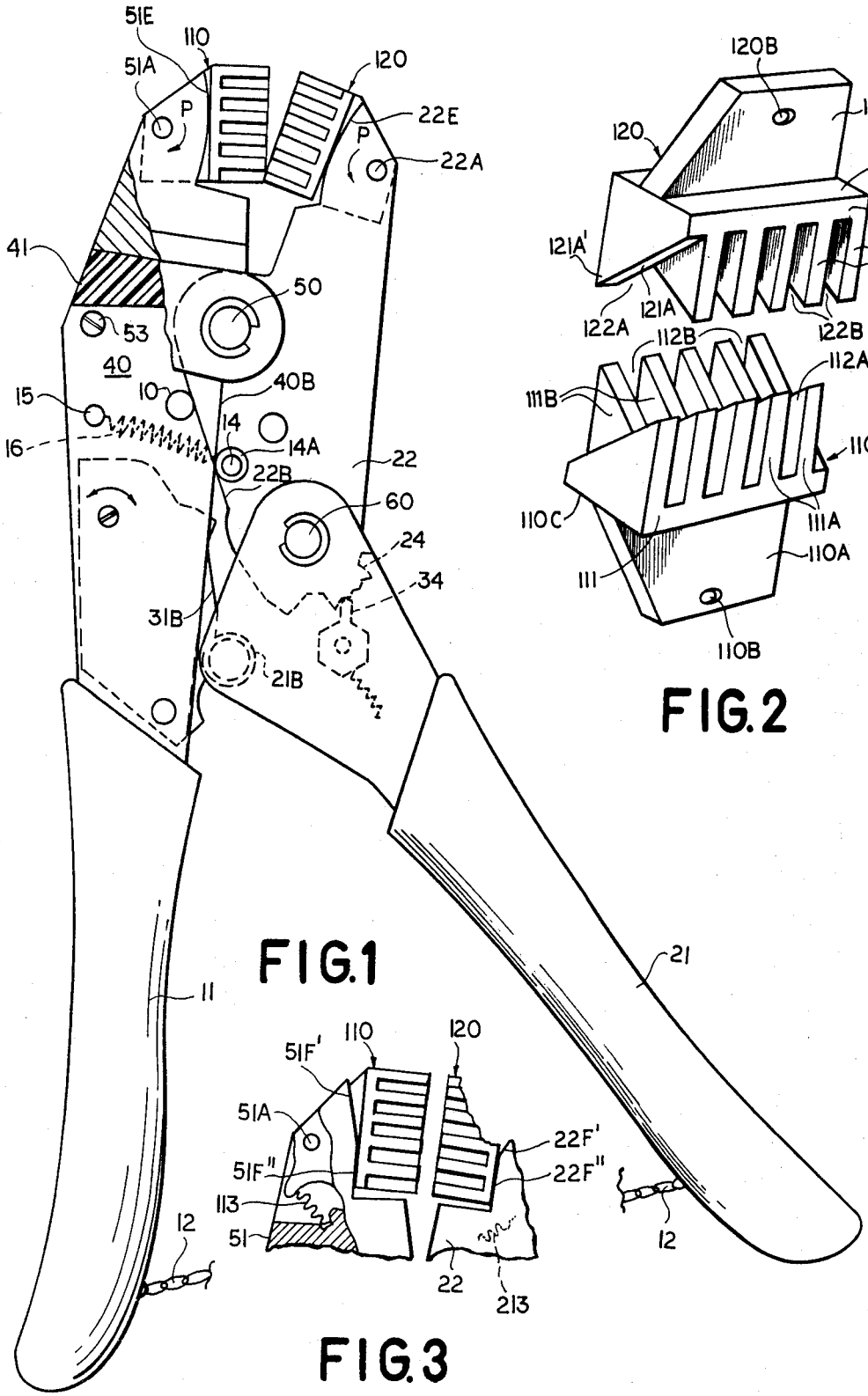
FIG.1
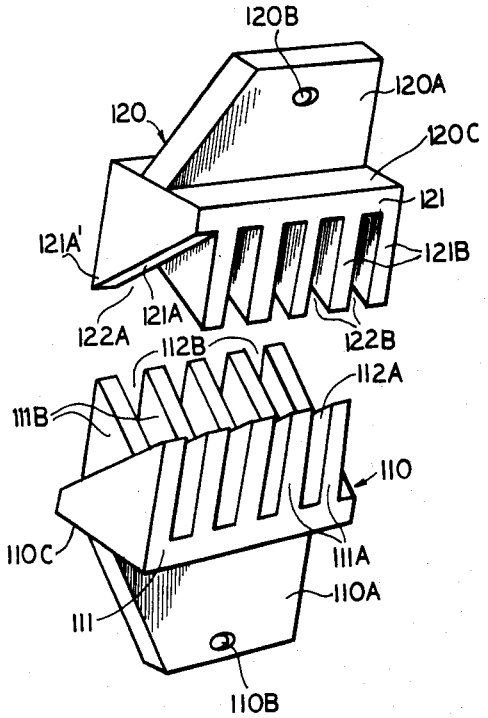
FIG.2
FIG.3

GRIPPING OR PRESSING TOOL

CROSS-REFERENCE TO RELATED APPLICATION

This application is a continuation-in-part of my copending application Ser. No. 852,724, now U.S. Pat. No. 4,199,972, filed Nov. 18, 1977 as a continuation-in-part of my prior application Ser. No. 647,641 filed Jan. 8, 1976, now U.S. Pat. No. 4,078,303.

FIELD OF THE INVENTION

My present invention relates to an appliance or tool, such as a pair of pliers or tongs, designed for the handling of workpieces of generally circular cross-section such as cables, rods or wires.

BACKGROUND OF THE INVENTION

Plier-type tools for gripping or holding a workpiece generally have two jaws mounted on shanks which are pivotally interconnected for relative swinging motion.

In order to exert a firm grip on an engaged workpiece, it is desirable to provide each jaw of such a tool with a multiplicity of engagement faces. A particularly advantageous jaw structure comprises a base provided with workpiece-gripping webs rising from a base, these webs having parallel major faces enabling them to slide into gaps between corresponding webs on another such jaw. The webs may have workpiece-engaging faces transverse to their major faces which are alternately inclined in opposite directions with reference to a midplane bisecting these major faces, thereby forming a V-shaped trough for the workpiece; as the two jaws interengage with their webs interleaved, the workpiece is squeezed in a contracting channel formed by their confronting troughs.

Such a jaw structure, known for well over fifty years (e.g. from German patent No. 340,581), requires a precise alignment of the webs of each jaw with the gaps of the opposite jaw to insure proper interfitting if the gap width only slightly exceeds the web thickness, as is obviously necessary if undesirable deformations of the workpiece are to be avoided. Thus, the prior art has used such jaws only with parallel motion in a vise-type appliance or in pliers provided with means for rectilinear guidance, as in the aforementioned German patent, or else with major web faces perpendicular to the pivotal axis as shown in Swiss patent No. 80,554.

OBJECT OF THE INVENTION

The object of my present invention, therefore, is to provide means in a plier-type tool for facilitating the coaction of two multi-web jaws without the need for a complex guidance system.

SUMMARY OF THE INVENTION

A tool according to my present invention comprises a pair of jaws of the above-described structure, i.e. with flat parallel webs rising from respective bases, which are swingably mounted on pivotally interconnected shanks with swing axes parallel to the pivotal shank axis and to the major web faces, as taught in my copending application, now U.S. Pat. No. 4,199,972 already referred to. With the webs perpendicular to the swing plane, their number is not restricted by considerations of bulk as would otherwise be the case. In order to obviate the need for manually aligning the webs of each jaw with the gaps of the other jaw as the two jaws approach their working position, I further provide swing-limiting means coupled with the jaws in their withdrawn position (facilitating the insertion of the workpiece) for so aligning the webs and gaps as to insure proper interengagement of the jaws with their webs interleaved.

One way of automatically bringing about such alignment is to prevent a withdrawal of the jaws from each other beyond a position of maximum separation in which at least some of the webs, specifically those closest to the pivotal shank axis, are still in contact with each other. This can be accomplished by stop means on the two shanks, e.g. an abutment on one shank and a coacting formation such as an edge on the other shank, or by a flexible link such as a chain anchored to both shanks at points remote from their pivotal axis. Another possibility, allowing the two jaws to be fully disengaged in their withdrawn position, is to provide resilient means urging each jaw against an abutment on the respective shank so as to establish a starting position in which each jaw is yieldably retained until it engages the opposite jaw; thereafter the two jaws reorient themselves, by a swinging motion, as the major faces of their webs slide on one another toward the interposed workpiece.

BRIEF DESCRIPTION OF THE DRAWING

The above and other features of my invention will now be described in detail with reference to the accompanying drawing in which:

FIG. 1 is a front-elevational view of a pair of crimping pliers according to the present invention;

FIG. 2 shows in geater detail the working jaws of the pliers of FIG. 1; and

FIG. 3 is a fragmentary elevational view similar to the upper part of FIG. 1, illustrating a modification.

SPECIFIC DESCRIPTION

In FIG. 1 I have shown a tool embodying my invention, specifically a pair of crimping pliers with handles 11 and 21 which form the operating means of the appliance. The movement of the handle 21 relative to the handle 11 is transmitted via a cam-and-cam-follower mechanism 21B, 31B, of a type more fully described in U.S. Pat. No. 4,048,877, to a limb or shank 22 which is articulated by a pivot pin 60 to handle 21 and by another pin 50 to a tool body 40 to which the handle 11 is rigidly attached. Also pivotally mounted on the pin 50 is a limb or shank 51 which carries a working jaw 110. A co-operating working jaw 120 is mounted on the shank 22. Between shank 51 and body 40 there is interposed a block 41 of elastomeric material, such as natural or synthetic rubber or polyurethane. A slot (not shown) in shank 51, co-operating with a pin 53 on the body 40, limits the pivotal movement of shank 51 relative to that body. It will be readily understood that the block 41 may be prestressed to a desired extent by selecting its dimensions relative to the dimensions of the space between the body 40 and the shank 51 into which the block 41 is fitted.

The working jaws 110,120 are shown on a larger scale and in more detail in FIG. 2. These jaws have the structure described and illustrated in my prior U.S. Pat. No. 4,078,303, comprising respective elongate bases 111, 121 with two interleaved groups of mutually parallel webs 111A, 111B and 121A,121B rising therefrom; the webs form engagement faces which are alternately inclined in opposite directions with reference to a longitudinal plane of symmetry of their base. The webs of each group are separated by gaps 112A, 112B and 122A, 122B accommodating respective webs of the other jaw when the handles 11, 21 are squeezed to establish a working position for the gripping of a workpiece or rounded cross-section, e.g. a pipe or cable as shown im my U.S. Pat. No. 4,078,303. The engagement faces of the two web groups of a jaw, being mutually symmetrical, intersect at a midplane longitudinally bisecting their base; each web, upon approaching or entering the corresponding gap of the opposite jaw, confronts another web whose engagement face is parallel to its own. Thus, the interengaging webs of the jaws moving into their working position form a closed channel about an inserted workpiece whose diameter may vary within wide limits.

It will be noted that the bases of jaws 110, 120 are shown in FIGS. 1 and 2 to be so positioned that the major faces of their webs lie in planes parallel to the pivotal axis of pin 50 so that their interleaving by a relative swinging of their shanks 22, 51 would require a certain widening of their gaps—in comparison with a tool such as a vise in which the jaws move parallel to each other—if these jaws were rigid with their respective shanks. Each jaw, however, is provided with a lug 110A, 120A (FIG. 2) mounted on a respective pivot pin 22A, 51A. Thus, the two jaws 110,120, as long as their webs 111A, 111B and 121A, 121B are interleaved, align themselves automatically so that the gaps 112B, 122B need not be significantly wider than the jaws 110, 120 confronting them. To relieve the pivots 22A, 51A from too high a stress, backing surfaces 22E, 51E formed as edges on the shanks 22, 51 are arcuately curved about the respective pins 22A, 51A which pass through openings 110B, 120B in the lugs 110A, 120A each spaced from the rear face 110C, 120C of the respective jaw base 111, 121 by a distance equal to the radius of curvature of the corresponding backing surface. Thus, the rear faces 110C, 120C of the jaws bear upon the curved surfaces 22E, 51E in each position of the working jaws 110,120.

In crimping pliers and similar appliances it is customary to provide a pawl-and-ratchet mechanism which does not permit the tool to be reopened before the compressing operation performed by the tool has been completely finished. A mechansim of this kind, more fully described in the aforementioned U.S. Pat. No. 4,048,877, comprises a ratchet 24 and a pawl 34 shown dotted in FIG. 1.

To assure the automatic alignment of the jaws 110, 120 during a squeezing operation, i.e. before an inserted cylindrical workpiece is contacted by both jaws, a stop pin 10 is provided in the tool body 40 adjacent the inner edge 40B thereof. When the jaws 110, 120 are moved from their working position into their withdrawn position, the shank 22 pivots clockwise around its fulcrum 50 and its lower portion in FIG. 1, carrying the pivot pin 60, approaches the tool body 40. The stop pin prevents any clockwise rotation of the shank 22 beyond the position of FIG. 1 in which the innermost webs of jaws 110, 120 still contact each other by their corner points (farthest from their bases 111, 121) so as to remain partially interleaved.

The same effect, i.e. the arresting of the shanks in a position of partial disengagement of their jaws, is achieved by another detent shown in FIG. 1, namely a collar 14A on a pin 14 coacting with the edge 40B of tool body 40. Pin 14 on shank 22 and another pin 15 on body 40 serve as anchors for a tension spring 16 tending to separate the jaws 110, 120 from each other.

A chain 12, likewise shown in FIG. 1, interconnects the handles 11 and 21 and is just long enough to allow the movement of the jaws between their illustrated withdrawn position and their working position in which all their webs are interleaved. It will be apparent that the stops 10, 12 and 14A need not to be used together but that any one of them will serve the purpose of positively guiding the two sets of webs into full interengagement by preventing their complete separation.

As the jaws 110, 120 approach each other when the handles 11, 21 are squeezed, their divergence (exaggerated in FIG. 1) diminishes as they swing in the direction of arrows P about their respective pins 51A, 22A until their webs are perfectly parallel to one another. This parallelism is maintained as the webs interpenetrate further, with reversal of their direction of swing relative to shanks 51,22.

In FIG. 3 I have shown the shanks 51, 22 provided with gable-shaped backing surfaces each comprising two straight edges 51F', 51F'' and 22F', 22F'' including an obtuse angle with each other. In their illustrated withdrawn position, in which the jaws 110, 120 are fully disengaged, these jaws are urged by respective biasing springs 113, 213 into full-face contact with the inwardly located edges 51F', 22F' with their webs almost parallel to one another. The parallelism becomes exact when the shanks 51, 22 are relatively rotated about their pivot pin 50 (FIG. 1) to eliminate the clearance therebetween; thereafter, jaws 110 and 120 swing couterclockwise and clockwise, respectively, coming into full-face contact with the outwardly located backing edges 51F', 51F'' in their position of closest approach. Such a position, of course, will be reached only with workpieces of a certain minimum diameter; with heavier workpieces, interpenetration will terminate earlier with application of a pressure depending on the force applied to the handles and on the elasticity of the pad 41 (FIG. 1) while the jaws bear upon the vertices of their gabled backing surfaces.

Stops such as those shown at 10, 12 and/or 14A in FIG. 1 could also be used with the spring-biased jaws of FIG. 3 but are not essential in that instance. The biasing springs 113, 213, on the other hand, may also be employed with arcuate backing surfaces like those of FIG. 1 as long as these surfaces—or some other abutments on shanks 51, 22—define the quasi-parallel jaw position of FIG. 3.

I claim:

1. A tool for handling workpieces of generally circular cross-section, comprising:

a first jaw and a second jaw each having a base and workpiece-gripping webs with parallel major faces rising from said base;

operating means including a pair of pivotally interconnected shanks enabling relative swinging of said jaws in a plane transverse to the pivotal axis of said shanks between a withdrawn position allowing insertion of a workpiece between said jaws and a working position in which the webs of said jaws are mutually interleaved, said jaws being swingably mounted on said shanks with swing axes parallel to said pivotal axis and to said major faces; and swing-limiting means operatively coupled with said jaws in said withdrawn position for aligning the webs of each jaw with respective gaps between the webs of the other jaw interengagement of said jaws with their webs interleaved upon displacement into said working position.

2. A tool as defined in claim 1 wherein said swing-limiting means comprises stop means on said shanks establishing a position of maximum jaw separation in which at least the webs of said jaws closest to said pivotal axis are in contact with each other.

3. A tool as defined in claim 2 wherein said stop means comprises an abutment on one of said shanks and a coacting formation on the other of said shanks.

4. A tool as defined in claim 2 wherein said stop means comprises a flexible link anchored to both said shanks at points remote from said pivotal axis.

5. A tool as defined in claim 2, 3 or 4 wherein each of said jaws has workpiece-engaging faces transverse to said major faces alternately inclined in opposite directions with reference to said plane, the webs closest to said pivotal axes contacting each other at points farthest from their respective bases in said position of maximum separation.

6. A tool as defined in claim 1 wherein said swing-limiting means comprises an abutment on each shank and resilient means urging the respective jaw against said abutment.

7. A tool as defined in claim 1, 2, 3, 4 or 6, further comprising an elastic pad inserted between said operating means and one of said jaws.

* * * * *